US006574933B1

(12) United States Patent
Devlin

(10) Patent No.: US 6,574,933 B1
(45) Date of Patent: Jun. 10, 2003

(54) MOVEMENT JOINT

(75) Inventor: Seamus Michael Devlin, Empshott (GB)

(73) Assignee: Vexcolt (UK) Limited, Hampshire (GB)

( * ) Notice: Subject to any disclaimer, the term of this patent is extended or adjusted under 35 U.S.C. 154(b) by 0 days.

(21) Appl. No.: 09/674,181

(22) PCT Filed: Apr. 13, 1999

(86) PCT No.: PCT/GB99/01118

§ 371 (c)(1),
(2), (4) Date: Dec. 14, 2000

(87) PCT Pub. No.: WO99/55986

PCT Pub. Date: Nov. 4, 1999

(30) Foreign Application Priority Data

Apr. 28, 1998 (GB) ..... 9808902

(51) Int. Cl.[7] ..... E04F 15/14

(52) U.S. Cl. ..... 52/396.05; 52/396.08; 52/396.1; 52/318; 52/747.11

(58) Field of Search ..... 52/396.05, 396.04, 52/396.06, 396.08, 396.1, 318, 747.11; 404/49, 68, 67

(56) References Cited

U.S. PATENT DOCUMENTS 1,667,313 A * 4/1928 Galassi
1,742,855 A * 1/1930 Galassi
1,889,651 A * 11/1932 Galassi
3,276,334 A * 10/1966 Rhodes
3,323,426 A * 6/1967 Hahn
3,396,640 A * 8/1968 Fujihara
3,455,215 A * 7/1969 Webb
3,589,087 A * 6/1971 Lazzero
3,593,626 A * 7/1971 Crone
3,900,271 A * 8/1975 Crone
5,168,683 A * 12/1992 Sansom et al.

FOREIGN PATENT DOCUMENTS

FR 2534329 * 4/1984
FR 2619844 * 3/1989
FR 2629845 * 10/1989

* cited by examiner

*Primary Examiner*—Robert Canfield
(74) *Attorney, Agent, or Firm*—Ware, Fressola Van Der Sluys & Adolphson LLP

(57) ABSTRACT

The joint thereshown has two stainless steel side plates (21, 22) which are rolled from a single strip and are bent double at the bottom of the lower limb (23) of the Y. The plates have rolled in ridges (24) at the top of this limb (23) and diverge above the ridges (24) as upper Y limbs (26). Between the limbs (26) a core is captivated at a relatively hard, necked lower core-portion or rib (31) by the ridges (24). Above these, a relatively softer upper core-portion or strip (32) fills the space between the upper limbs (26), tapering out with them. The core is a co-extrusion of the two portions (31, 32) joined by a neck (33). It is held in place by the ridges (24) being rolled around lower portion (31). This joint is fitted between tiles at a gap of the width of the ridges (24), by driving it between the tiles to compress the divergent upper Y limbs (26).

24 Claims, 3 Drawing Sheets

MOVEMENT JOINT

TECHNICAL FIELD

The present invention relates to a movement joint.

BACKGROUND OF THE INVENTION

Structural movement between individual parts of a building can and often does occur particularly in large buildings. The integrity of the building is seldom threatened, provided that it is adequately designed. However unsightly cracking in floors and walls in particular can be avoided by providing a movement joint known as a "field limitation joint" in the finish layer of these surfaces. Generally such a joint includes a flexible member which is able to expand and compress with movement of the substrate layer(s) beneath the finish layer. The joint may induce cracking of the substrate along its length, whereby the finish layer does not crack, but can move as a block with respect to one or more adjacent blocks separated by the joint or several joints.

SUMMARY OF THE INVENTION

The object of the present invention is to provide a method of fitting a field limitation joint to a faced floor or wall and to provided an improved field limitation joint.

According to one aspect of the invention there is provided a method of fitting a field limitation joint to a faced floor or wall, the joint having a Y cross-section with compressible material in the space between the divergent upper limbs of the Y, the method consisting in the steps of:

laying a hardenable bed on the floor or wall, setting flat facing members on the hardenable bed in an array, with a defined field limitation line at a gap between certain of the arrayed members, the gap having a defined width, which is less than the free width of at least the distal ends of the upper limbs of the Y, inserting the field limitation joint into one of the gaps to a depth such that upper limbs of Y rest on the facing members at the gap and the joint protrudes proud of the facing members and driving the joint into the gap until its top is flush with the surface of the facing members, the lower limb of the Y penetrating the hardenable bed, the upper limbs of the Y being displaced towards each other with the compressible material between the upper limbs being compressed.

Preferably, the spaces between the facing members which are not to receive a joint are grouted prior to fitting of the joint.

In one procedure, the hardenable bed is cut along the field limitation line prior to inserting of the joint, the cut preferably having adhesive applied into it. Alternatively, the hardenable bed is cut by the field limitation joint being inserted into the gap between the facing members.

Preferably, the gaps defining the field limitation lines are regulated by laying the facing members along the lines with a spacer of a defined width therebetween. Usually, the spacer is removed prior to insertion of the joint.

In the preferred embodiment, the spacer is a portion of the joint, which is narrower than the free width of the upper limbs of the Y. preferably a lateral swelling at the junction of the Y, the joint being driven home once the members along it have been stabilised by at least partial hardening of the bed and/or grouting oft hem.

Preferably, all the facing members are spaced identically and the joint has a compressed width equal to the spacing of the tiles which are grouted.

According to another aspect of the invention there is provided a field limitation joint for the method of the first aspect of the invention, the joint comprising a core of relatively compressible material and side members of relatively incompressible material, the side members having the core bonded or otherwise affixed between them and abutting the facing members when driven between them, a downwards extension of the side members beneath the core with the side members unified or abutting in the extension, the side members and the extension defining a divergent Y-shape in cross-section, when free of abutment with the facing members prior to driving, the side members being upper limbs of the Y and the extension the lower limb of the Y whereby on fitting of the movement joint into a field limitation gap between facing members which is narrower than the width of the joint at the distal ends of the Y, they at least are compressed between the facing members.

In one embodiment, the core is an elastomeric insert and the side members are metallic, The metal side members can be welded together in the lower limb of the Y. Alternatively, the metal side plates are rolled from a single strip and bent double at the bottom of the lower limb of the Y. In either alternative, the elastomeric insert can have a lower rib connected to an upper strip by a thinner section, the metal side plates being rolled to shape to captivate the lower rib. In this case, the elastomeric insert is conveniently a co-extrusion of a harder material in the rib and a softer material in the upper strip. Another possibility is for the upper limbs of the Y have inward deformations to captivate the elastomeric insert.

In another embodiment, the field limitation joint is a co-extrusion of a relatively rigid plastics material comprising the limbs of the Y and a less rigid plastics material between the upper limbs of the Y comprising the core.

Preferably, the joint has a rigid portion having a gauge width thicker than the lower limb of the Y and thinner than the free width of at least the distal ends of the upper limbs of the Y, and defining the design compressed width thereof. Ususally, the rigid portion will be a lateral swelling at the junction of the limbs of the Y.

The building elements will normally be tiles or other slab like elements such as terrazo which has sufficient rigidity to compress the core on fitting of the joint to the elements or the elements to the joint.

BRIEF DESCRIPTION OF THE DRAWINGS

To help understanding of the invention, two specific embodiments thereof will now be described by way of example and with reference to the accompanying drawings, in which:

BEST MODE FOR CARRYING OUT THE INVENTION

Figure 1:
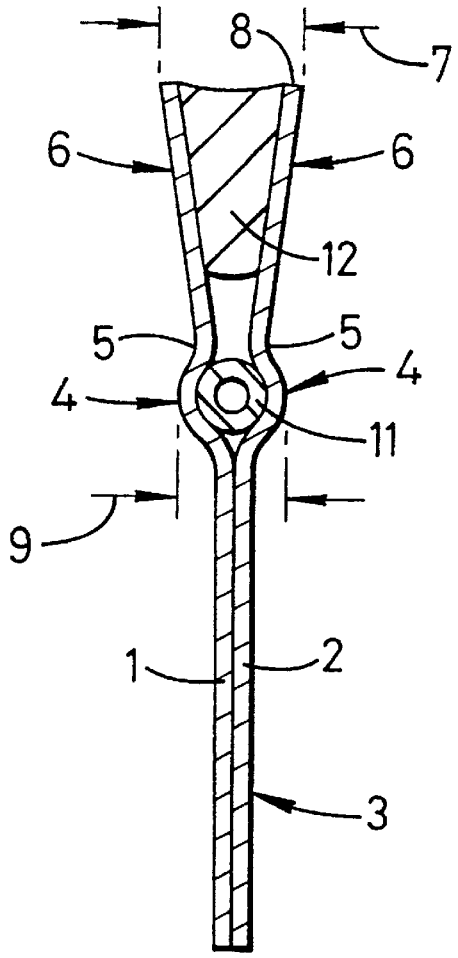
Figure 2:
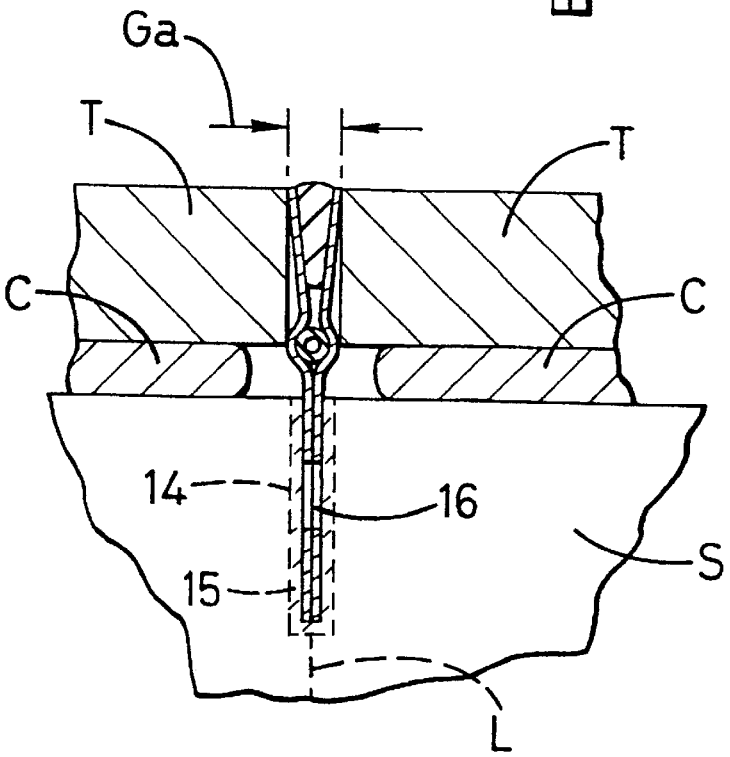
Figure 3:
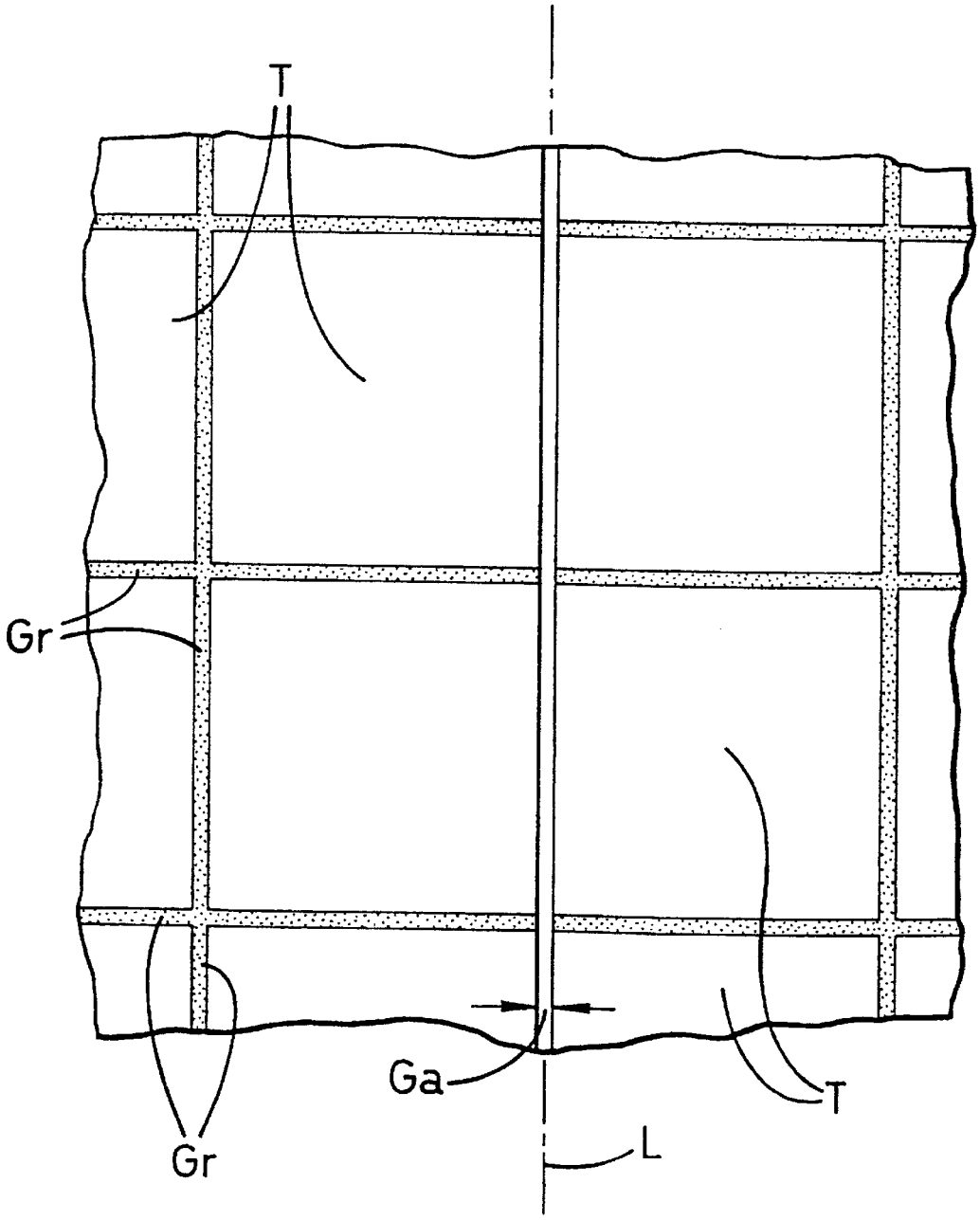
Figure 4:
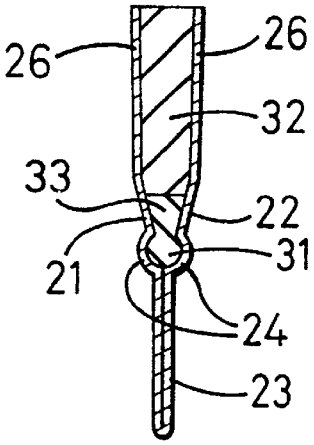
Figure 5:
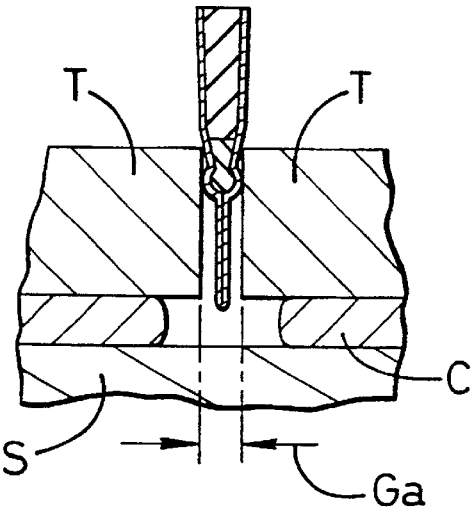
Figure 6:
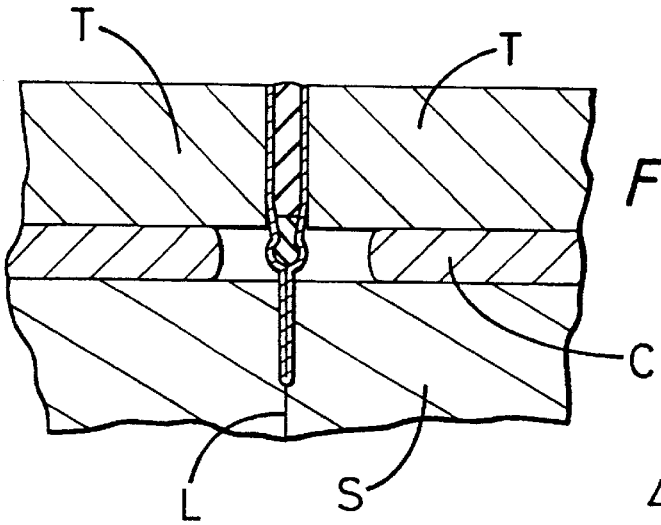
Figure 7:
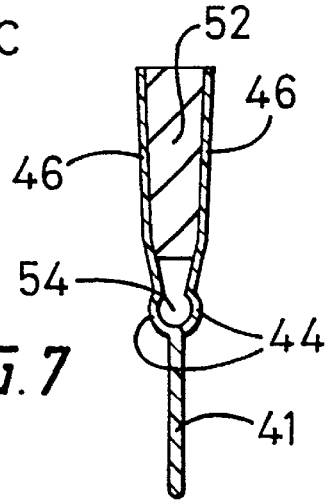

FIG. 1 is a cross-sectional end view of a first movement joint of the invention;

FIG. 2 is a similar view on a smaller scale of the joint as fitted between tiles;

FIG. 3 is a plan view of the joint fitted between the tiles;

FIG. 4 is a cross-sectional view of a second movement joint of the invention on the same scale as FIG. 1;

FIG. 5 is a view similar to FIG. 2 showing an initial stage of fitting of the second joint;

FIG. 6 is a view similar to FIG. 5 showing a subsequent stage in the fitting of the second joint;

FIG. 7 is a cross-sectional view of a third movement joint of the invention on the same scale as FIG. 1.

The joint of FIG. 1 has metal side plate 1,2—typically of stainless steel, brass or aluminium—of uniform thickness. The plates are flat in their lower portions 3, where they are spot welded together. Along (and slightly above) their mid-portion, they have raised ridges 4, above which they neck in 5 and taper out 6 again to a maximum separation 7 at the top edges 8. Typically their maximum separation—in the free state of the joint—is a third as much again as the dimension 9 across the raised ridges 4. However the separation can be between half as much again and a quarter as much again. The side plates can be seen to be of a general Y-shape.

Within the ridges, the joint has a secondary core 11 of relatively hard, typically 50°–60° and preferably 65° Shore Hardness, elastomeric tube. Between the tapering portions 6 of the side plates, a primary core 12 is provided of softer material, typically of 15°–35° and preferably 20°–25° Shore Hardness. Both cores can be of silicone or neoprene material for instance.

For use of the joint, as shown in FIGS. 2 & 3, tiles T are laid along a field limitation line L with a constant gap Ga. Preferably this is set with a gauge (not shown) having a thickness equal to that of the ridge dimension 9, i.e. less than the top edge separation 7. The joint itself can be used as the gauge, by means of the ridges 4. When the tile cement C has set off sufficiently to keep them fixed, possibly with their edges opposite from the gap Ga grouted Gr, but whilst the substrate screed S is still green, the gauge is removed and the joint inserted (or left in place when used as the gauge). It will readily fit until its bottom edge touches the screed and/or the tapered portions 6 rest on the edges of the tiles. Where, as will often be the case, the bottom edge touches first, the joint is further inserted until the tapered portions touch the tiles. The joint is then carefully driven into the gap until flush with the finish surface of the tiles. This process compresses the primary core, so that should the tiles tend to shrink away from the joint, the core will re-expand, keeping closed the abutment of the side plates with the tiles. Driving of the side plates into the screed will establish and induced crack line L, whereby when the screed tenids to shrink, it should not crack elsewhere beneath the tiles. In an alternative, a groove 14 is cut in the screed prior to fitting of the joint to adepth suitable to accommodate the lower limb. It can be filled with adhesive 15, to secure the joint. To help in enabling the adhesive to grip the joint, the lower limb can have apertures 16 cut through it at regular intervals along its length.

Whilst this joint is envisaged to be suitable for a variety of sizes of tile and other floor and wall coverings, it has initially been developed for use with tiles intended to be laid with a 3 mm grouting gap. The gauge thickness for which the joint is designed is the same 3 mm. Thus the dimension 9 across the raised ridges 4 is 3 mm for this joint, whilst the initial dimension of the maximum separation 7 at tile top edges 8 is typically 4 mm. The top of the primary core 12 is then compressed by 1 mm. The side plates are 0.5 mm thick and 25 mm high. With this thickness of the plates, the secondary core 11 has an outside diameter of 2 mm and an inside diameter of 1 mm.

Turning now to FIGS. 4, 5 & 6, the joint thereshown has two stainless steel side plates 21,22, which are rolled from a single strip and are bent double at the bottom of the lower limb 23 of the Y. The plates have rolled in ridges 24 at the top of this limb and diverge above the ridges as upper Y limbs 26. Between the limbs a core is captivated at a relatively hard, necked lower core-portion or rib 31 by the ridges 24. Above these, a relatively softer upper core-portion or strip 32 fills the space between the upper limbs, tapering out with them. The core is a co-extrusion of the two portions 31,32 joined by a neck 33. It is held in place by the ridges being rolled around lower portion. This joint is fitted in the same manner as the joint of FIGS. 1 & 2. The tiles T are laid with a gap Ga equal to the dimension across the ridges 24. The joint can be used as a gauge for this, as shown in FIG. 5. After setting of the cement between the tiles and the green substrate to a sufficient extent to hold the tiles, the joint is pushed in until it rests via the upper limbs against the edges of the tiles. In this embodiment this is at portions of the side plates corresponding to the neck 33 of the core. Then the joint is driven more firmly between the tiles, with resultant compression of the side members and the core in the upper part of the Y. The lower limb of the joint penetrates the green substrate S establishing the field limitation line L.

Turning on to FIG. 7, the joint thereshown is of similar cross-section to that of the above embodiments. However it is a co-extrusion of hard plastics material for the limbs 41,46 of the Y and an elastomeric core 52 between the upper limbs 46. Gauge ridges 44 are provided at the junction of the limbs. They define a hollow 54, which is not filled with core material in this embodiment, so that when the joint is fitted, the core material between the upper limbs 46 can be squeezed both upwards to swell above the distal ends of the limbs and downwards into the hollow.

The invention is not intended to be restricted to the details of the above described embodiment. In particular, there may be no ridges 4,24. In the co-extrusion embodiment, the ridge 24 may be solid, as opposed to hollow. Further, the lower limb may be of the same tile gap gauge width throughout its height.

What is claimed is:

1. A method of fitting a field limitation joint to a faced floor or wall, the joint having a Y cross-section with compressible material in the space between the divergent upper limbs of the Y, the method comprising the steps of:

laying a hardenable bed on the floor or wall, setting flat facing member on the hardenable bed in an array, with a defined field limitation line at gaps between certain of the arrayed members, the gaps having a defined width, which is less than the free width of the upper limbs of the Y, inserting the field limitation joint into one of the gaps to a depth such that upper limbs of Y rest on the facing members at the gap and the joint protrudes proud of the facing members and driving the joint into the gap until its top is flush with the surface of the facing members, the lower limb of the Y penetrating the hardenable bed, the upper limbs of the Y being displaced towards each other with the compressible material between the upper limbs being compressed.

2. A method as claimed in claim 1, wherein the spaces between the facing members which are not to receive a joint are grouted prior to fitting of the joint.

3. A method as claimed in claim 1, wherein the hardenable bed is cut along the field limitation line prior to inserting of the joint, the cut having adhesive applied into it.

4. A method as claimed in claim 1, wherein the hardenable bed is cut by the field limitation joint being inserted into the gap between the facing members.

5. A method as claimed in claim 1, wherein the gap defining the field limitation line is regulated by laying the facing members along the line with a spacer of a defined width therebetween.

6. A method as claimed in claim 5, wherein the spacer is removed prior to insertion of the joint.

7. A method as claimed in claim 5, wherein the spacer is a portion of the joint, which is narrower than the free width of the upper limbs of the Y, preferably a lateral swelling at the junction of the Y, the joint being driven home once the members along it have been stabilised.

8. A method as claimed in claim 7, wherein the stabilisation is by at least partial hardening of the bed and/or the use of spacers between facing members other than at the field limitation lines and/or by grouting of the facing members.

9. A method as claimed in claim 1, wherein all the facing members are spaced identically and the joint has a compressed width equal to the spacing of tiles which are grouted.

10. A field limitation joint, comprising:

a core of substantially compressible material and side members of material that is less compressible that the substantially compressible material, the side members having the core affixed between them and abutting facing members when driven between them, a downwards extension of the side members beneath the core with the side members unified or abutting in the extension, the side members and the extension defining a divergent Y-shape in cross-section, when free of abutment with the facing members prior to driving, the side members being upper limbs of the Y and the extension the lower limb of the Y, wherein the joint has a rigid portion having a gauge width thicker than the lower limb of the Y and thinner than the free width of at least the distal ends of the upper limbs of the Y, and defining the design, compressed width thereof.

11. A field limitation joint as claimed in claim 10, the core being an elastomeric insert and the side members being metallic, the metal side members being welded together in the lower limb of the Y.

12. A field limitation joint as claimed in claim 10, the core being an elastomeric insert and the side members being metallic, the metal side plates being rolled from a single strip and bent double at the bottom of the lower limb of the Y.

13. A field limitation joint as claimed in claim 11, wherein the elastomeric insert has a lower rib connected to an upper strip by a thinner section, the metal side plates being rolled to shape to captivate the lower rib.

14. A field limitation joint as claimed in claim 13, wherein the elastomeric insert is a co-extrusion of a harder material in the rib and a softer material in the upper strip.

15. A field limitation joint s claimed in claim 11, wherein the upper limbs of the Y have inward deformations to captivate the elastormeric insert.

16. A field limitation joint as claimed in claim 10, the joint being a co-extrusion of a relatively rigid plastics material comprising the limbs of the Y and a less rigid plastics material between the upper limbs of the Y comprising the core.

17. A field limitation joint as claimed in claim 10, wherein the said rigid portion is a lateral swelling at the junction of the limbs of the Y.

18. A field limitation joint as claimed in claim 10, wherein the design compressed width of the joint is the design grouting spacing of facing members to which the joint is to be fitted.

19. A field limitation joint as claimed in claim 10, wherein the lower limb of the Y has spaced apertures therethrough for filling with adhesive in a cut in a hardenable bed.

20. A field limitation joint as claimed in claim 10, wherein the distal ends of the upper limbs diverge by between one quarter and one half as much again as the design width of a gap to which the joint is to be fitted.

21. A field limitation joint as claimed in claim 14, wherein the harder material has a Shore Hardness between 50° and 60° and the softer material has a Shore Hardness between 15° and 35°.

22. A field limitation joint according to claim 12, wherein the elastomeric insert has a lower rib connected to an upper strip by a thinner section, the metal side plates being rolled to shape to captivate the lower rib.

23. A field limitation joint as claimed in claim 22, wherein the elastomeric insert is a co-extrusion of a harder material in the rib and a softer material in the upper strip.

24. A field limitation joint according to claim 12, wherein the upper limbs of the Y have inward deformations to captivate the elastomeric insert.

* * * * *

UNITED STATES PATENT AND TRADEMARK OFFICE

CERTIFICATE OF CORRECTION

PATENT NO. : 6,574,933 B1
DATED : June 10, 2003
INVENTOR(S) : Devlin

It is certified that error appears in the above-identified patent and that said Letters Patent is hereby corrected as shown below:

Title page,
Item [75], Inventor, "Empshott" should read -- Hampshire --

Column 1,
Line 61, after "Y" "." should be -- , --
Line 64, "oft hem" should be -- of them --

Signed and Sealed this

Thirtieth Day of December, 2003

JAMES E. ROGAN
*Director of the United States Patent and Trademark Office*